US011014588B2

(12) United States Patent
Saxena et al.

(10) Patent No.: US 11,014,588 B2
(45) Date of Patent: May 25, 2021

(54) COMPUTING TRAIN ROUTE FOR PTC ONBOARD SYSTEM TO NAVIGATE OVER A LOOP TRACK

(71) Applicant: Westinghouse Air Brake Technologies Corporation, Wilmerding, PA (US)

(72) Inventors: Amit Saxena, Marion, IA (US); James A. Oswald, Coggon, IA (US)

(73) Assignee: WESTINGHOUSE AIR BRAKE TECHNOLOGIES CORPORATION, Wilmerding, PA (US)

( * ) Notice: Subject to any disclaimer, the term of this patent is extended or adjusted under 35 U.S.C. 154(b) by 416 days.

(21) Appl. No.: 16/220,814

(22) Filed: Dec. 14, 2018

(65) Prior Publication Data

US 2020/0189632 A1 Jun. 18, 2020

(51) Int. Cl.

| | |
|---|---|
| ***G05D 1/00*** | (2006.01) |
| ***B61L 23/04*** | (2006.01) |
| ***B61L 3/00*** | (2006.01) |
| ***B61L 25/02*** | (2006.01) |
| ***B61L 23/00*** | (2006.01) |

(52) U.S. Cl.

CPC ..... *B61L 23/042* (2013.01); *B61L 3/006* (2013.01); *B61L 23/007* (2013.01); *B61L 25/023* (2013.01)

(58) Field of Classification Search

CPC ..... B61L 23/042; B61L 3/006; B61L 23/007; B61L 25/023

See application file for complete search history.

(56) References Cited

U.S. PATENT DOCUMENTS

| | | | | |
|---|---|---|---|---|
| 8,979,363 | B2 * | 3/2015 | Groeneweg | B61L 23/042 374/141 |
| 9,162,691 | B2 * | 10/2015 | Polivka | B61L 3/243 |
| 9,475,511 | B2 * | 10/2016 | Tippey | B61L 15/009 |
| 2020/0108848 | A1 * | 4/2020 | Garmson | B61L 25/023 |
| 2020/0189632 | A1 * | 6/2020 | Saxena | B61L 3/006 |

* cited by examiner

*Primary Examiner* — Adam M Alharbi

(74) *Attorney, Agent, or Firm* — Christopher R. Carroll; The Small Patent Law Group LLC

(57) ABSTRACT

A train navigation system and method are provided for safely navigating a track loop in a railway, by determining a head end location of a train navigating a track block in a plurality of track blocks associated with a track loop in the railway; determining a train route from the head end location of the train including a forward path and a rearward path, the train route based on a position of a switch in the plurality of track blocks associated with the track loop in the railway; the system and method for dynamically generating an updated train route as the train traverses the railway based on a continuously updated head end location as the train traverses the railway relative to the position of the switch; and safely traversing the track loop in the railway based upon the updated train route.

20 Claims, 8 Drawing Sheets

COMPUTING TRAIN ROUTE FOR PTC ONBOARD SYSTEM TO NAVIGATE OVER A LOOP TRACK

BACKGROUND

Field of the Invention

The present invention relates generally to navigating a loop track, and, in particular, a train navigation method for safely determining a track route for navigating a track loop in a railway and dynamically updating a train route based on one or more track blocks in the track loop.

Description of Related Art

There is a growing movement to transport more material by rail as production of goods reaches capacity. Additional and improved safety systems are required to solve problems in current systems. Thus, there are efforts to improve the safety of systems used to determine the routing of a train, including train navigation systems. One such safety system, for example, is a train computing system generally used to provide a segment of track in advance of the train and a segment of track in back of the train, compiled into a route. The computing system may include methods for providing a track route determined from the current location of the train to provide a train (e.g., an operator, etc.) a view of the route ahead, under, and behind the train, for example, starting from the head end location of the train (e.g., locomotive, etc.) initially selected by the crew and maintained via GPS signal and one or more dead reckoning mechanisms. The train computing system may determine the head end location of the train and include the one or more track segments in advance of the train and, likewise, to a rear direction for finding a route in any track in advance, under, and behind the head end location.

SUMMARY

In some non-limiting embodiments or aspects, provided are train systems and methods of determining a route for navigating a track loop, computer-implemented switch locking methods, and computer program products for a train. Preferably, provided are improved systems, methods, and computer program products that overcome certain deficiencies and drawbacks associated with existing navigation systems, methods, and computer program products.

In one non-limiting embodiment or aspect, provided is a train navigation method for safely navigating a track loop in a railway. The method may include: determining, by a computing system having one or more processors, a head end location of a train navigating a track block in a plurality of track blocks associated with the track loop in the railway; determining, by the computing system, a train route from the head end location of the train including a forward path and a rearward path, the train route based on a position of a switch in the plurality of track blocks associated with the track loop in the railway; dynamically generating, by the computing system, an updated train route as the train traverses the railway, based on a continuously updated head end location as the train traverses the railway relative to the position of the switch; and safely traversing the track loop in the railway based upon the updated train route.

In another non-limiting embodiment or aspect, provided is an on-board navigation system for generating a route in a railway. The method may include, a computing system including one or more processors configured to: determine a head end location of a train navigating a track block in a plurality of track blocks associated with the track loop in the railway; determine a train route from the head end location of the train including a forward path and a rearward path, the train route based on a position of a switch in the plurality of track blocks associated with the track loop in the railway; dynamically generate an updated train route as the train traverses the railway, continuously update the head end location as the train traverses the railway relative to the position of the switch.

In another non-limiting embodiment or aspect, provided is an on-board dynamic train control method for safely traversing a track loop in a railway. The method may include: determining, by a computing system having one or more processors, route data including a first track block in a forward path of a looping switch in a track loop; generating, by the computing system, an updated route based on the route data, the updated route including the first track block in a rearward path of the updated route data based on an updated position of the train relative to the looping switch; determining, by an on-board computer having one or more processors, total route distance of the track loop; and safely traversing the track loop based upon the updated route.

In another non-limiting embodiment or aspect, provided is a train navigation method for safely navigating a track loop in a railway. The method may include: determining, by a computing system having one or more processors, a head end location of a train navigating a track block in a plurality of track blocks associated with the track loop in the railway; determining, by the computing system, a train route from the head end location of the train, including a forward path and a rearward path, the train route based on a position of a switch in the plurality of track blocks associated with the track loop in the railway; dynamically generating, by the computing system, an updated train route as the train traverses the railway based on a continuously updated head end location as the train traverses the railway relative to the position of the switch.

The present invention is neither limited to nor defined by the above summary. Rather, reference should be made to the claims for which protection is sought with consideration of equivalents thereto.

Further non-limiting embodiments or aspects will now be described in the following numbered clauses:

Clause 1: A train navigation method for safely navigating a track loop in a railway, the method comprising: determining, by a computing system having one or more processors, a head end location of a train navigating a track block in a plurality of track blocks associated with the track loop in the railway; determining, by the computing system, a train route from the head end location of the train, including a forward path and a rearward path, the train route based on a position of a switch in the plurality of track blocks associated with the track loop in the railway; dynamically generating, by the computing system, an updated train route as the train traverses the railway, based on a continuously updated head end location as the train traverses the railway relative to the position of the switch; and safely traversing the track loop in the railway based upon the updated train route.

Clause 2: The train navigation method according to clause 1, further comprising: identifying, by the computing system, the switch as a looping switch based on the switch in a location of the track block starting the track loop in the railway and the track block ending the track loop in the railway; and determining the train route by determining the position of the switch in a subset of track blocks of the plurality of track blocks in the forward path, wherein the subset of track blocks of the plurality of track blocks in the forward path are before the switch and the subset of track blocks of the plurality of track blocks in the rearward path are in a location after the switch.

Clause 3: The method according to clauses 1 and 2, wherein the train route includes at least one of the forward path in at least one track block of the plurality of track blocks in an advance of the train, a path in at least one track block of the plurality of track blocks behind the end of the train, an occupied path in at least one track block of the plurality of track blocks under the train, or any combination, wherein at least one of the forward path or the rearward path includes the occupied path under the train.

Clause 4: The method according to clauses 1-3, wherein determining route data comprises: determining a portion of the rearward path starting at a head of the train, including one or more segments of track and one or more switches, the one or more switches associated with track segments longer than a length of the train to cover; determining the forward path extending in advance of the head of the train, including one or more segments of track and one or more switches; and determining the rearward path by combining the portion of the rearward path with a remaining rearward path extending behind the end of the train.

Clause 5: The method according to clauses 1-4, wherein the forward path includes the last track block preceding a looping switch if the looping switch is already included in the rearward path, and wherein the remaining rearward path includes the last track block preceding the looping switch if the looping switch is already included in the forward path generated.

Clause 6: The method according to clauses 1-5, wherein determining the forward path, further comprises determining the forward path includes the segment of track associated with the head of the train.

Clause 7: The method according to clauses 1-6, wherein safely traversing the track loop based upon the updated route is accomplished by operating the train on the updated route including predictive enforcement in advance of the train, further comprising: controlling the train in the track loop based on determining the length of the subset of blocks in the track loop is greater than the length of the train.

Clause 8: The method according to clauses 1-7, wherein safely traversing the track loop includes operating the train on the updated route based on reactive protection associated with one or more portions of the train, comprising: predicting an upcoming condition in the forward path; and controlling the train based on the upcoming condition.

Clause 9: The method according to clauses 1-8, comprising: comprising: automatically issuing a train control command based on a condition in the rearward path under any portion of the train.

Clause 10: An on-board navigation system for generating a train route in a railway, comprising: a computing system including one or more processors configured to: determine a head end location of a train navigating a track block in a plurality of track blocks associated with a track loop in the railway; determine the train route from the head end location of the train including a forward path and a rearward path, the train route based on a position of a switch in the plurality of track blocks associated with the track loop in the railway; dynamically generate an updated train route as the train traverses the railway, based on a continuously updated head end location as the train traverses the railway relative to the position of the switch; and safely traverse the track loop in the railway based upon the updated train route.

Clause 11: The on-board navigation system according to clause 10, wherein the computing system is further configured to: identify the switch as a looping switch based on the switch in a location of the track block starting the track loop in the railway and the track block ending the track loop in the railway; and determine the train route by determining the position of the switch in a subset of track blocks of the plurality of track blocks in the forward path, wherein the subset of track blocks of the plurality of track blocks in the forward path are before the switch and the subset of track blocks of the plurality of track blocks in the rearward path are in a location after the switch.

Clause 12: The on-board navigation system according to clauses 10 and 11, wherein the train route includes at least one of the forward path in at least one track block of the plurality of track blocks in an advance of the train, a path in at least one track block of the plurality of track blocks behind the end of the train, an occupied path in at least one track block of the plurality of track blocks under the train, or any combination, wherein at least one of the forward path or the rearward path includes the occupied path under the train.

Clause 13: The on-board navigation system according to clauses 10-12, wherein the computing system is further configured to determine the route data by: determining a portion of the rearward path starting at a head of the train, including one or more segments of track and one or more switches, the one or more switches associated with track segments longer than a length of the train to cover; determining the forward path extending in advance of the head of the train, including one or more segments of track and one or more switches; and determining the rearward path by combining the portion of the rearward path with a remaining rearward path extending behind the end of the train.

Clause 14: The on-board navigation system according to clauses 10-13, wherein the forward path includes a last track block preceding the looping switch if the looping switch is already included in the rearward path and the remaining rearward path includes the last track block preceding the looping switch if the looping switch is already included in the forward path generated.

Clause 15: The on-board navigation system according to clauses 10-14, wherein the forward path includes the segment of track associated with the head of the train.

Clause 16: The on-board navigation system according to clauses 10-15, wherein the computing system is further configured to safely traverse the track loop based upon the updated route by: operating the train on the updated route including predictive enforcement in advance of the train; and predicting the upcoming condition in the forward path; and controlling the train based on the upcoming condition.

Clause 17: The on-board navigation system according to clauses 10-16, wherein the computing system is further configured to: operate the train on the updated route based on reactive protection associated with one or more portions of the train; and control the train in the track loop based on determining the length of the subset of blocks in the track loop is greater than the length of the train.

Clause 18: An on-board dynamic train control method for safely traversing a track loop in a railway, the method comprising: determining, by a computing system having one or more processors, route data including a first track block in a forward path of a looping switch in a track loop; generating, by the computing system, an updated route based on the route data, the updated route including the first track block in a rearward path of the updated route data based on an updated position of the train relative to the looping switch; determining, by an on-board computer having one or more processors, total route distance of the track loop; and safely traversing the track loop based upon the updated route.

Clause 19: The on-board dynamic train control method according to clause 18, wherein safely traversing the track loop further comprises: operating the train on the updated route based on reactive protection associated with one or more portions of the train; predicting an upcoming condition in the forward path based on the distance of the track loop; and controlling the train based on the upcoming condition.

Clause 20: The on-board dynamic train control method according to clauses 18 and 19, wherein safely traversing the track loop further comprises: operating the train on the updated route including predictive enforcement in advance of the train, further comprising: determining the looping switch in the railway associated with a segment of track for entering the track loop in the railway; and safely traversing the track loop based upon the updated train route by controlling the train in the track loop based on determining a length of a subset of blocks in the track loop is greater than the length of the train.

DESCRIPTION

Figure 1A:
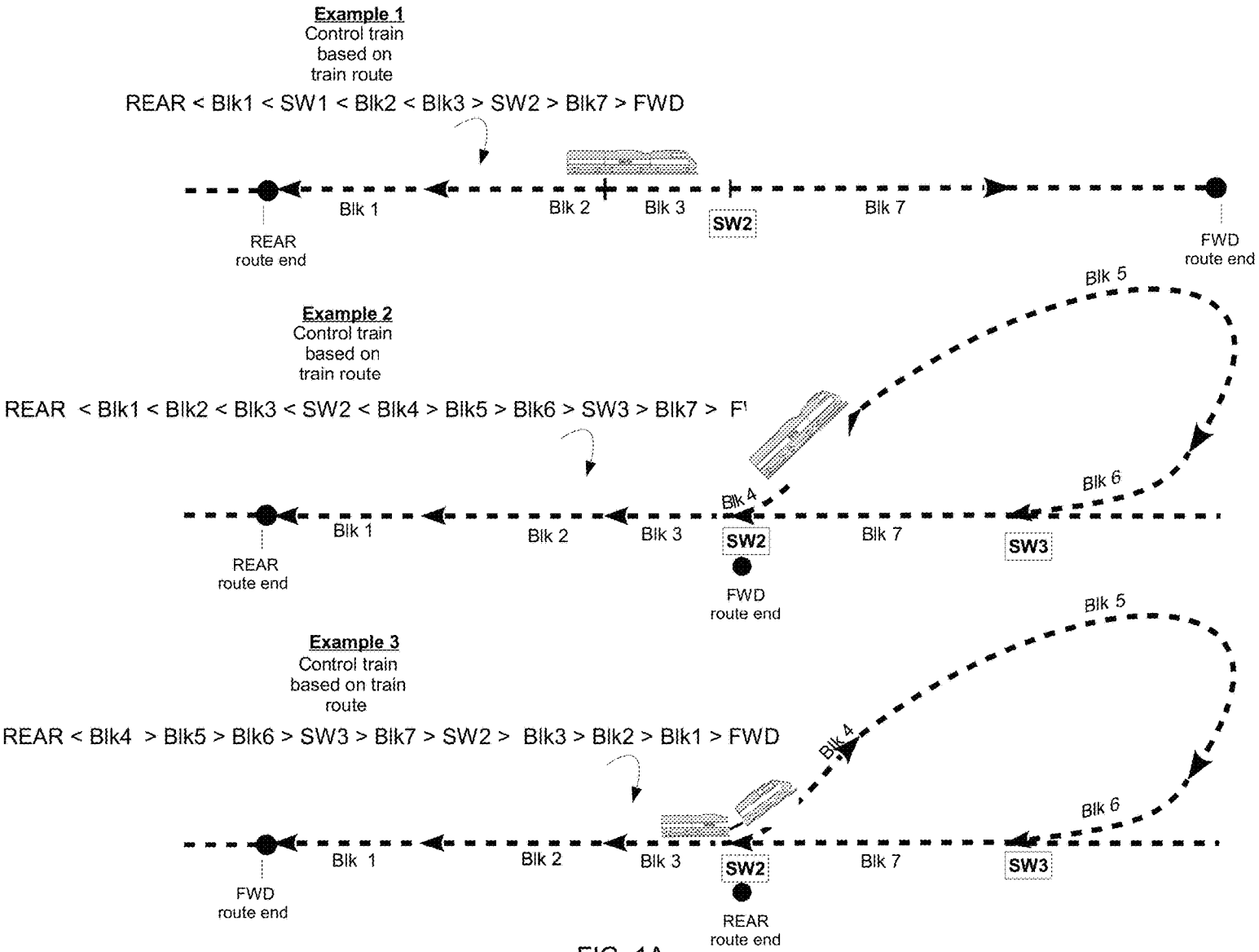
FIG. 1A illustrates examples of potentially unsafe routes for navigating a route in a railway.

It is to be understood that the present disclosure may assume various alternative variations and step sequences, except where expressly specified to the contrary. It is also to be understood that the specific devices and processes illustrated in the attached drawings, and described in the following specification, are simply exemplary and non-limiting embodiments or aspects. Hence, specific dimensions and other physical characteristics related to the embodiments or aspects disclosed herein are not to be considered as limiting.

For purposes of the description hereinafter, the terms "end," "upper," "lower," "right," "left," "vertical," "horizontal," "top," "bottom," "lateral," "longitudinal," and derivatives thereof shall relate to embodiments or aspects as they are oriented in the drawing figures. However, it is to be understood that embodiments or aspects may assume various alternative variations and step sequences, except where expressly specified to the contrary. It is also to be understood that the specific devices and processes illustrated in the attached drawings, and described in the following specification, are simply non-limiting exemplary embodiments or aspects. Hence, specific dimensions and other physical characteristics related to the embodiments or aspects disclosed herein are not to be considered as limiting unless otherwise indicated.

No aspect, component, element, structure, act, step, function, instruction, and/or the like used herein should be construed as critical or essential unless explicitly described as such. Also, as used herein, the articles "a" and "an" are intended to include one or more items, and may be used interchangeably with "one or more" and "at least one." Furthermore, as used herein, the term "set" is intended to include one or more items (e.g., related items, unrelated items, a combination of related and unrelated items, etc.) and may be used interchangeably with "one or more" or "at least one." Where only one item is intended, the term "one" or similar language is used. Also, as used herein, the terms "has," "have," "having," or the like, are intended to be open-ended terms. Further, the phrase "based on" is intended to mean "based at least partially on" unless explicitly stated otherwise.

As used herein, the terms "communication" and "communicate" may refer to the reception, receipt, transmission, transfer, provision, and/or the like of information (e.g., data, signals, messages, instructions, commands, and/or the like). For one unit (e.g., a device, a system, a component of a device or system, combinations thereof, and/or the like) to be in communication with another unit means that the one unit is able to directly or indirectly receive information from and/or transmit information to the other unit. This may refer to a direct or indirect connection that is wired and/or wireless in nature. Additionally, two units may be in communication with each other even though the information transmitted may be modified, processed, relayed, and/or routed between the first and second unit. For example, a first unit may be in communication with a second unit even though the first unit passively receives information and does not actively transmit information to the second unit. As another example, a first unit may be in communication with a second unit if at least one intermediary unit (e.g., a third unit located between the first unit and the second unit) processes information received from the first unit and communicates the processed information to the second unit. In some non-limiting embodiments or aspects, a message may refer to a network packet (e.g., a data packet and/or the like) that includes data. It will be appreciated that numerous other arrangements are possible.

As used herein, the term "computing device" may refer to one or more electronic devices that are configured to directly or indirectly communicate with or over one or more networks. A computing device may be a mobile or portable computing device, a desktop computer, a server, and/or the like. Furthermore, the term "computer" may refer to any computing device that includes the necessary components to receive, process, and output data, and normally includes a display, a processor, a memory, an input device, and a network interface. A "computing system" may include one or more computing devices or computers. An "application" or "application program interface" (API) refers to computer code or other data sorted on a computer-readable medium that may be executed by a processor to facilitate the interaction between software components, such as a client-side front-end and/or server-side back-end for receiving data from the client. An "interface" refers to a generated display, such as one or more graphical user interfaces (GUI) with which a user may interact, either directly or indirectly (e.g., through a keyboard, mouse, touchscreen, etc.). Further, multiple computers, e.g., servers, or other computerized devices, such as a vehicle computing system, directly or indirectly communicating in the network environment, may constitute a "system" or a "computing system".

It will be apparent that the systems and/or methods described herein can be implemented in different forms of hardware, software, or a combination of hardware and software. The actual specialized control hardware or software code used to implement these systems and/or methods is not limiting of the implementations. Thus, the operation and behavior of the systems and/or methods are described herein without reference to specific software code, it being understood that software and hardware can be designed to implement the systems and/or methods based on the description herein.

Some non-limiting embodiments or aspects are described herein in connection with thresholds. As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, etc.

In some non-limiting embodiments or aspects, while traversing a route in a track network, a train may traverse a track topology including a track loop. For example, although a route may include a number of primarily straight track segments (e.g., a plurality of track blocks, etc.), a route may also include a track loop that defines a segment of track having a loop (e.g., a balloon, a repeat, etc.) where the track blocks and switches are aligned in a way such that the track blocks (e.g., the track blocks forming the track loop, etc.) may be traversed a plurality of times (e.g., a track loop in advance of the train, a track loop to a rear of the train, etc.).

However, although a route may include route data, existing computing systems may not accurately and/or efficiently determine a loop route for safely traversing a track loop. Existing computing systems may determine a route based on route data in a track network based on static track data (e.g., track data associated with one or more track blocks, etc.), switch data (e.g., switch alignments received from a train authority for traveling on a switch leg of a switch, etc.) and/or the like. For example, in existing computing systems, a route may be calculated to include a first track block at a location of the head of the train, and additional track blocks from a portion of the track network in a forward direction, such as, for example, additional track blocks in advance of the train that are coupled to the first track block (e.g., keep walking till a preconfigured distance is covered in advance of the train). Similarly, a route may include additional track blocks to a rear of the train (e.g., behind the train, etc.) that are coupled to and starting from a track block behind the first track block at the head end location.

With reference to FIG. 1A, as shown in FIG. 1A, Example 1 provides a route in one or more track blocks and one or more switches (e.g., a sequence and/or subset of at least one or more track blocks and one or more switches, etc.) between a track block that is in a last block behind the train to a track block in a first track block in advance of the train. For example, in Example 1, an existing computing system may determine only the front and rear routes. In Example 1, the route may include, a first block, block three under a head of train location, (e.g., a track block three (BLK3) containing the head of the train block, a track block etc.,), switch 2 (e.g., SW2, a switch in the forward path, etc.), Blk7 (e.g., a track block in a route in a forward direction of the train (e.g., FWD of Blk3, etc.)), Blk2 (e.g., a first track block in rearward direction of the train (e.g., REAR of Blk3, etc.), switch 1 (e.g., SW1, a switch in the rearward path, etc.), and Blk1 (e.g., one or more track blocks in the rearward path until reaching the route end, etc.) The route may provide an ordered list of track blocks and switches from a rear end to a head end (e.g., Blk1<SW1<Blk2>Blk3>SW2>Blk7, etc.).

With continuing reference to FIG. 1A, in another example shown in FIG. 1A, Example 2 shows a computed route in one or more track blocks and one or more switches from a first track block under the head of the train. As shown, Example 2 provides a route by determining a rearward route before determining a forward route. Accordingly, Example 2 provides a first block, Blk5, under a head of the train, and a rearward route connected to Blk5, including track blocks Blk1, Blk2, Blk3, and Blk4 (e.g., Blk4, Blk3, Blk2, and Blk1, SW1, etc.). As shown in Example 2, however, if a rearward route is determined first, a forward route may be unsafe and/or incomplete, may include insufficient track blocks and/or include only a forward route with a portion of the track blocks in advance of the train, such as track blocks Blk6 or Blk7 (e.g., Blk6 and Blk7, etc.) instead of all of the track blocks in advance of the train. In this example, some of the track blocks positioned in the front of the train may already be included in track blocks in a rearward route (e.g., Blk 3, Blk2, and Blk1, etc.), may not be in the forward path because they are in the rearward path (e.g., published in the route data as being behind the train, etc.), and may not be considered in some safety systems (e.g., Positive Train Control (PTC) on-board system's predictive protection, etc.).

With continued reference to FIG. 1A, in another example shown in FIG. 1A, Example 3 provides a route in one or more track blocks and one or more switches from the first track block under the head of the train. As shown, Example 3 provides a route by determining a forward route before a rearward route. Accordingly, Example 3 provides a first block, Blk5, in a location under a head of the train, the forward route further including any track blocks or switches in advance of Blk5 in the track network (e.g., Blk7>SW2>Blk3>Blk2>SW1>Blk1, etc.). As shown, Example 3 provides a route by determining a rearward route after determining the forward route (e.g., in contrast to Example 1, where a rearward route is determined first, etc.). In Example 3, the rearward route is determined from one or more of the remaining track blocks that were not used in the forward route, such as Blk4 (e.g., a first block in rearward direction of the train, behind Blk5, etc.). As shown in Example 3, a route determined in this way, may not be safe and/or may not include any of the one or more track blocks to the rear of the train, such as track blocks sufficient to determine a reactive movement in the track network. For example, including Blk3 with the forward route (e.g., Blk3 positioned in a location where at least a portion remains under the train, etc.) may eliminate any reactive moves to be made based on having a portion of a train in Blk3 to a rear of the head of the train (e.g., behind switch 3, etc.). As shown, Example 3 may provide an unsafe route, as track blocks (e.g., Blk1, Blk2, Blk3, etc.) are already included in a forward path, and may not be considered during traversal by a PTC on-board system's reactive protection. As shown in Example 2, Blk3 (e.g., Blk3, Blk2, and Blk1, SW1, etc.) is included in the forward route and not available for a rearward route calculation of the train. Additionally, existing computing systems may not accurately describe a route including one or more routes, such as, for example, a track loop, may not accurately determine a route without including duplicate entries, improperly ordered and omitted blocks and/or switches, may not be capable of efficiently determining a route including track blocks and switches to be used for controlling the train for traversing the track network on a travel path through all track segments behind, under, and/or in advance of the train, may not receive safe and proper instructions from a PTC on-board system, a navigation system, and/or the like.

As disclosed herein, in some non-limiting embodiments or aspects, a train navigation system and method for safely navigating a track loop in a railway may include: determining a head end location of a train navigating a track block in a plurality of track blocks associated with the track loop in the railway; determining a train route from the head end location of the train, including a forward path and a rearward path, the train route based on a position of a switch in the plurality of track blocks associated with the track loop in the railway; dynamically generating an updated train route as the train traverses the railway based on a continuously updated head end location as the train traverses the railway relative to the position of the switch; and safely traversing the track loop in the railway based upon the updated train route. In this way, a train navigation system may more accurately determine one or more track blocks for a route including one or more routes, such as, for example, a track loop, to more accurately determine a route without including duplicate entries, properly order routes in a forward and rearward direction, omit blocks and/or switches, or to efficiently determine a route including track blocks and switches to be used for controlling the train for traversing a route. Additionally, the navigation system and method may reduce operational hazards, provide uninterrupted navigation in geographically difficult/challenging areas, more accurately navigate through a loop without losing a track location, more sufficiently provide an overall throughput such as a track loop being more accurately generated, more efficiently traverse through all track segments behind, under, and/or in advance of the train, and, more safely and properly protect a train in a route generated by a PTC on-board system.

Figure 1B:
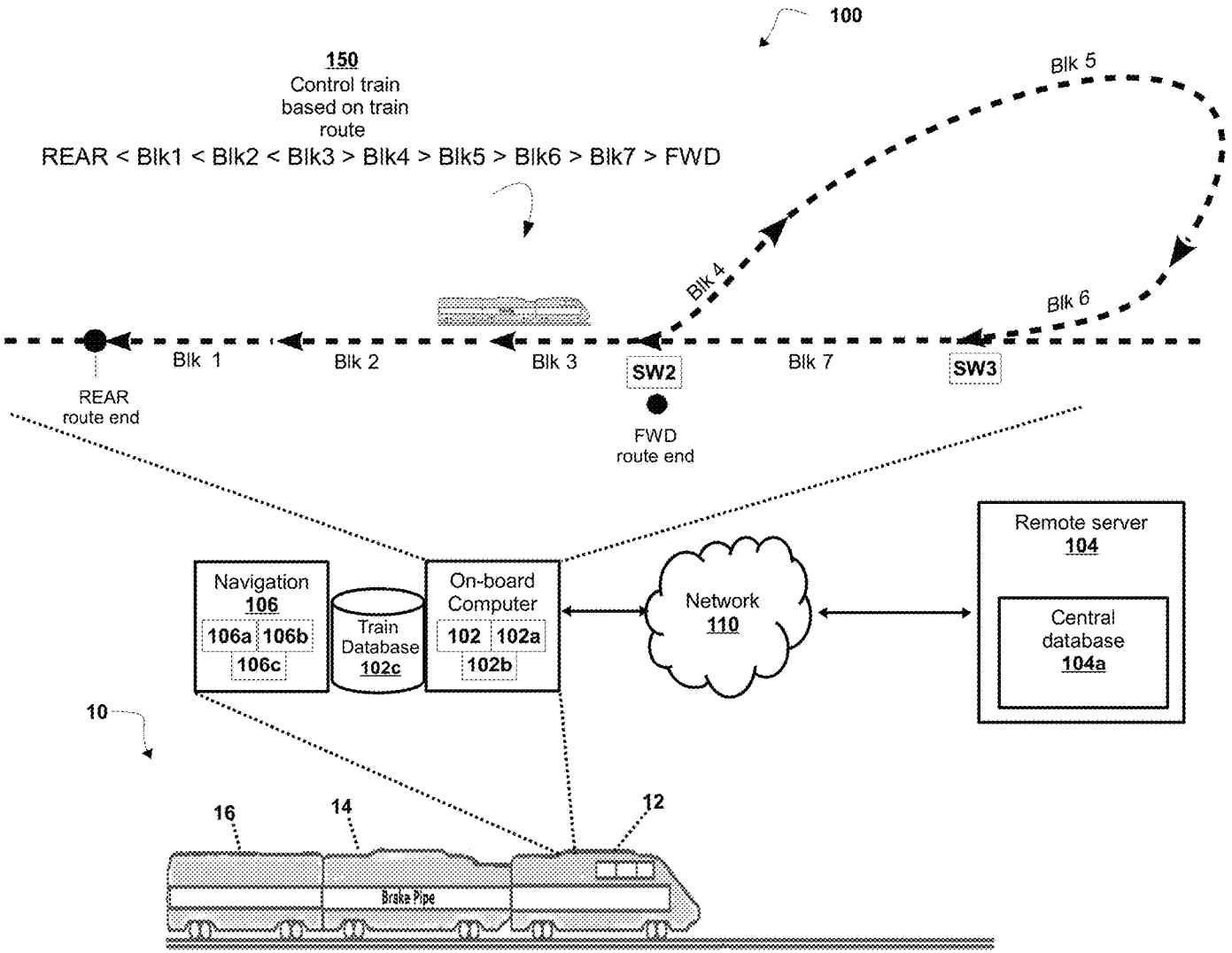
FIG. 1B illustrates a train and a train navigation system for safely navigating a track loop in a railway according to a preferred and non-limiting embodiment or aspect.

Referring now to FIG. 1B, FIG. 1B is a diagram of a non-limiting embodiment or aspect of a train navigation system for navigating a track loop in a railway 100 in which systems and/or methods, described herein, can be implemented. In some non-limiting embodiments or aspects of train navigation system 100, train 10 includes a locomotive 12, one or more railcars 14, and an end of train railcar 16. Systems and/or devices of train navigation system 100 can interconnect via wired connections, wireless connections, or a combination of wired and wireless connections.

With continued reference to FIG. 1B, some non-limiting embodiments or aspects of the train navigation system and method 100 described herein may be implemented on or in connection with an on-board computer 102 of at least one locomotive 12 in train 10, providing a communication device 102*a*, a display interface 102*b*, and a train database 102*c*. In some non-limiting embodiments or aspects, the on-board computer 102 may be located at any position or orientation on the train. In some non-limiting embodiments or aspects, the on-board computer 102 (e.g., on-board controller, on-board PTC system, train management computer, and/or the like) performs the calculations for determining a route. As an example, the on-board computer 102 performs the calculations for determining a route, while controlling travel, operation, and/or routing of train 10 based on information about track positions or locations, track block locations or information, switch locations or information, signal information, track heading changes, curves, distance measurements, train information, the total length of the train, the specific identification numbers of each locomotive, and/or the like.

In some non-limiting embodiments or aspects, on-board computer 102 (which performs calculations for or within the PTC on-board system, including route navigation calculations, etc.), includes, for example, a PTC on-board system, a communication device 102*a* or data radio (which may be used to facilitate the communications between the on-board computer 102 in one or more of the locomotives 12 of a train 10, communications with a wayside device, (e.g., signals, switch monitors, and the like), and/or communications with a remote server 104 (e.g., a back office server, a central controller, central dispatch, etc.)), a display unit 102*b* which may be provided in the locomotive 12 to visually display route information and data to the operator, as well as display information and data input by the user, a train database 102*c* (e.g., which may include track and/or train information and data, track block information such as information about track positions or locations, switch locations or information, signal information, track heading changes (e.g., curves, etc.), distance measurement (e.g., distance measurements between track positions or locations, etc.), train information (e.g., the number of locomotives, the number of cars, the number of conventional passenger cars, the total length of the train, etc.), the specific identification numbers of locomotives where PTC equipment (e.g., an on-board computer 102) is located, and the like), and a navigation system 106 (optionally including a positioning system 106*a* (e.g., a Global Positioning System (GPS), a dead reckoning mechanism, etc.), speed sensor 106*b* (e.g., a wheel tachometer, GPS, an odometer differentiated in time, etc.), and/or at least one inertial sensor 106*c* (e.g., a rotational sensor, an accelerometer, a gyroscope, etc.) that is configured to measure the rate of the heading change for the locomotive 10, such as a PTC-equipped locomotive 12). In some non-limiting embodiments or aspects, at least a portion of the information (e.g., received location data and/or railway data) may be populated in or stored in at least one central database 104*a*, such as a remote database accessible by or through the remote server 104. Accordingly, the location data and/or railway data is accessible throughout and useful within the track network by any connected or communicative locomotive 12 of any travelling train 10 (or other vehicle) for navigational or other purposes.

In some non-limiting embodiments or aspects, on-board computer 102 includes a PTC on-board system. For example, the on-board computer 102 may perform all on-board route generation for the PTC of the train 10, and in some non-limiting embodiments or aspects, the on-board computer 102 determines its location, (e.g., the location of a head end of train 10, a position of a locomotive 12, and/or a railcar 14 associated with the PTC on-board system, etc.), determines a location of a switch (e.g., a looping switch, and generates loop routes for the train 10 on its route when navigating a track network.

In some non-limiting embodiments or aspects, on-board computer 102 records a latest or current locomotive position of locomotive 12 in the track network. For example, the train location information can include the location or position of the train 10 in the track network, the location or position of at least one locomotive 12 in the track network, the location or position of the at least one railcar 14 in the track network, the location or position of a target (e.g., a visual barrier or a track heading change, such as a curve in the track network), and the location or position of the target with respect to the location or position of the train 10 in the track network, or any combination thereof. In some non-limiting embodiments or aspects, the train location information can include current speeds of the train 10, current accelerations of the train 10, a number of locomotives 12 in the trains 10, a number of railcars 14 in the train 10, a total length of each of the train 10, or any combination thereof. In some non-limiting embodiments or aspects, the on-board computer 102 determines train location at regular intervals (e.g., predetermined intervals, etc.).

In some non-limiting embodiments or aspects, communication network 110 includes one or more wired and/or wireless networks. For example, communication network 110 includes a cellular network (e.g., a long-term evolution (LTE) network, a third generation (3G) network, a fourth generation (4G) network, a fifth generation (5G) network, a code division multiple access (CDMA) network, etc.), a public land mobile network (PLMN), a local area network (LAN), a wide area network (WAN), a metropolitan area network (MAN), a telephone network (e.g., the public switched telephone network (PSTN)), a private network, an ad hoc network, an intranet, the Internet, a fiber optic-based network, a cloud computing network, and/or the like, and/or a combination of these or other types of networks, such as electronic communication protocols and/or algorithms may be used including, for example, TCP/IP (including HTTP and other protocols), WLAN (including 802.11 and other radio frequency-based protocols and methods), analog transmissions, Global System for Mobile Communications (GSM), private wireless, public wireless, 160/220/900 MHz VHF, Wi-Fi, UHF 452-458 MHz, WiMAX, Omni-directional, and/or the like.

In some non-limiting embodiments or aspects, provided is a train navigation system 100 for a train 10 having at least one locomotive 12 (e.g., a control car, etc.). In some non-limiting embodiments or aspects, the train 10 may include one or more second locomotives 12 and/or one or more railcars 14. In some non-limiting embodiments or aspects, the train 10 is traversing a track which may include a loop track, such as a sharp curve or other looping railway maneuver in the track network. In some non-limiting embodiments or aspects, the on-board computer 102 is positioned on or integrated with one or more of the locomotives 12 and t programmed or configured to implement or facilitate at least one train action. Further, the one or more locomotives 12 are equipped with the communication device 102*a* that is in direct or indirect communication with the on-board computer 102 and programmed or configured to receive, transmit, and/or process data signals.

In some non-limiting embodiments or aspects, on-board computer 102 controls movement at a defined speed if a visual barrier prevents train movement (e.g., lower than the maximum restricted speed, etc.). In some non-limiting embodiments or aspects, on-board computer 102 may receive and/or obtain an indication of inclement weather (e.g., an operator may indicate inclement weather conditions are present, etc.).

In some non-limiting embodiments or aspects, on-board computer 102 generates an audible warning, a visual indication, and/or a request for an acknowledgment input if the train 10 does not slow down. For example, on-board computer 102 generates the visual indication on display 102*b* and allows the train operator to operate at a more restrictive speed and prevent a braking application. For example, when the train encounters a segment of track associated with a visual barrier over which one of an initial stop target is in force and the train 10 nevertheless exceeds the speed restriction, the on-board computer 102 will activate the audible warning device, visual warning device, and/or the like. If the train operator does not initiate a service brake application so that the train 10 comports with the speed profile, the on-board computer 102 will automatically impose a brake application to slow and/or stop the train 10.

As shown by reference number 150 in FIG. 1B, in some non-limiting embodiments or aspects, train navigation system 100 is configured to determine a route in one or more track blocks and one or more switches from the first track block at a position under the head of the train (e.g., Blk3, etc.). As further shown, on-board computer 102 determines no additional path under the train behind the first block (e.g., Blk2, etc.). As further shown, on-board computer 102 determines a forward path in advance of the first block (e.g., in a forward orientation, etc.), Blk4, including one or more track blocks or switches in advance of the first block, (e.g., Blk3>Blk4>Blk5>Blk6>Blk7>FWD route end, etc.). As further shown, on-board computer 102 determines a rearward path behind the train, Blk4, however no track blocks are behind the first blocks, and the rearward path includes only the track blocks under the train, (e.g., REAR route end<Blk1<Blk2<, etc.).

In some non-limiting embodiments or aspects, on-board computer 102 determines a route as the train 10 is traversing a previous route. For example, in some non-limiting embodiments or aspects, an updated route is determined based on an updated position and may generate an updated route (e.g., a different route, etc.).

In some non-limiting embodiments or aspects, on-board computer 102 may determine a route ahead of the train 10 (e.g., a distance in advance, etc.) and some distance behind the train 10. For example, on-board computer 102 maintains at least one of a target, signal, and switch behind the train.

In some non-limiting embodiments or aspects, a route may start at the head end and include one or more track blocks extending in advance of the train 10 (e.g., 5 miles ahead, 5 miles behind the train if the train is traveling in reverse, etc.) For example, on-board computer 102 may use or obtain (e.g., find, etc.) all blocks ahead and behind the train 10. For example, on-board computer 102 may include a marker to indicate a route for a block that may not link to another track block because it did not load for some reason. For example, a marker may be included to indicate a map may not include a sufficient amount of track blocks, not enough data to determine a complete path, and/or the like to indicate to operators and/or users that the route may be incomplete to operate the train. For example, on-board computer 102 determines a forward path including a mapped track block. In some non-limiting embodiments or aspects, on-board computer 102 may determine a mapped track block that was previously provided. For example, on-board computer 102 may provide a marker indicating a route end (e.g., a FWD route end, REAR route end, etc.) when a rearward path reaches a track block included in a forward path. In some non-limiting embodiments or aspects, for example, on-board computer 102 may not include a track block in a route more than once.

In some non-limiting embodiments or aspects, on-board computer 102 determines the route by providing one or more track blocks under the train 10 in a rearward path (e.g., at least a portion of a rear path, etc.) and providing one or more track blocks in advance of the train as a forward route (e.g., at least a portion of a forward path, etc.).

In some non-limiting embodiments or aspects, on-board computer 102 determines the route from the first track block associated with a position of the train 10 (e.g., a position of a track block containing a position associated with the head of the train 10, etc.). For example, on-board computer 102 includes the first track block associated with the position of the head of the train 10 as a first entry in the forward path of the route. For example, in some non-limiting embodiments or aspects, on-board computer 102 determines or stores the first track block based on the position of the head of the train 10 (e.g., stores in track database, etc.).

In some non-limiting embodiments or aspects, on-board computer 102 determines the train orientation before determining a route, after determining a first track block, etc. In some non-limiting embodiments or aspects, a forward orientation is provided when a head of the train is established as the leading edge. In some non-limiting embodiments or aspects, a head of the train is the rear of the train when the rear of the train is established as the leading edge. For example, in some non-limiting embodiments or aspects, on-board computer 102 determines a train orientation (e.g., a forward orientation with a head of the train 10 as the leading edge, a rearward orientation with a rear of the train 10 as the leading edge, etc.) after determining a first track block associated with the head of the train 10.

In some non-limiting embodiments or aspects, on-board computer 102 determines one or more track blocks behind the head of the train 10 (e.g., behind the first track block, etc.). For example, on-board computer 102 determines the rear path to include the one or more track blocks under the train 10 from the head of the train. As such, the on-board computer 102 may determine at least one track block under the train 10 before the end of the train 10 (e.g., finds any track blocks under the train from a position behind a first block associated with the head of the train 10, etc.) to cover the track under the train 10. In some non-limiting embodiments or aspects, on-board computer 102 determines at least a first portion of the rear path (e.g., adds a track block, etc.) based on the one or more track blocks under the train 10 based on a length of the track blocks covering the train 10 (e.g., the one or more track blocks having a length greater than the train 10, etc.).

In some non-limiting embodiments or aspects, on-board computer 102 determines one or more track blocks under the train 10, until finding a track block not under the train 10 (e.g., establishing one or more blocks under the train 10 based on the position of the train 10, etc.). In some non-limiting embodiments or aspects, after determining a track block is not under the train 10, on-board computer 102 provides a marker (e.g., a marker in a position in a path to indicate an end (e.g., a null entry, a 0 entry, etc.), etc.) indicating an end of a mapped track in at least a portion of the rear path (e.g., an availability of track data in the database, a track block is available in the route data, etc.).

In some non-limiting embodiments or aspects, on-board computer 102 generates a forward path after determining the portion of track under the train 10 as part of the rear path (e.g., after providing an indication, after providing a marker showing no more track block entries under the train 10, etc.). For example, on-board computer 102 determines a forward path based on the head of the train 10, after finding a rearward path under the train 10. In some non-limiting embodiments or aspects, on-board computer 102 determines a forward path to include one or more track blocks in advance of the train 10 (e.g., walking the track to generate a forward path from the head end position of the first track block, etc.). For example, on-board computer 102 determines one or more track blocks in an advance of the train 10 (e.g., a position in advance of the train 10, etc.) that is not already included in the route (e.g., unmapped track, etc.). As an example, on-board computer 102 determines a track block from one or more track blocks in advance of the first block that are not under the train 10. In some non-limiting embodiments or aspects, on-board computer 102 may provide an indication (e.g., a marker, etc.) to indicate an end of a mapped track in a forward path.

In some non-limiting embodiments or aspects, on-board computer 102 continues with the rearward path, after finishing the forward path. For example, in some non-limiting embodiments or aspects, on-board computer 102 generates the rearward path by generating a portion of the rearward path providing the one or more track blocks behind the train 10 (e.g., starting from behind the train 10, etc.). For example, on-board computer 102 determines the portion of the rear path to include the one or more track blocks behind the train 10 (e.g., track blocks that are not previously added to a route and/or a portion of a route, track blocks that are unmapped, etc.).

In some non-limiting embodiments or aspects, on-board computer 102 generates a route including one or more switches. For example, on-board computer 102 determines the route (e.g., the forward path, the rearward path, a portion of a path, etc.) to include one or more switches of the route (e.g., adds switches, etc.). The on-board computer 102 may determine a path including one or more switches in the one or more track blocks to represent the position of the one or more switches relative to the position of the one or more track blocks in the geographical area associated with the track network.

In some non-limiting embodiments or aspects, on-board computer 102 determines the route by providing the switch in the path, the switch at the position of the one or more switches in the track network (e.g., a forward path, a rearward path, a path under the train, etc.) between the one or more track blocks of the path.

In some non-limiting embodiments or aspects, on-board computer 102 determines the path is complete based on the looping switch. For example, on-board computer 102 determines the route end based on the position of the looping switch previously added to the path. For example, on-board computer 102 determines the end to the forward path if the looping switch is associated with both the entry and the exit to the loop track. For example, on-board computer 102 provides or generates the forward path associated with the loop track by identifying the looping switch based on the entry position (e.g., a position entering the loop track, etc.). The on-board computer 102 determines the end to the loop track based on the exit position (e.g., a position associated with exiting the loop track, etc.) if the switch was previously in the path. For example, on-board computer 102 provides the end to the forward path after determining the switch was previously included in the sequence of track blocks of the forward path for entering the track loop. In some non-limiting embodiments or aspects, on-board computer 102 provides a marker, indicating an end to the forward path at the position of an exit from the loop track (e.g. at an end of the loop track opposite the end used for entering, etc.).

In some non-limiting embodiments or aspects, on-board computer 102 provides a marker associated with the looping switch in the path to indicate an end to the path (e.g., a forward path, a rearward path, etc.). For example, if the looping switch is previously added to the path (e.g., the switch was added in a position where a train 10 entered a track loop, etc.), a marker is added after determining the switch in the path a second time to indicate that the path is complete, to stop generating the route for that direction (forward/rear), and/or the like. In some non-limiting embodiments or aspects, on-board computer 102 may provide a loop indication based on determining an end of a loop track (e.g., add an empty block and set a loop status flag to indicate the loop condition in the route, etc.).

Figure 2:
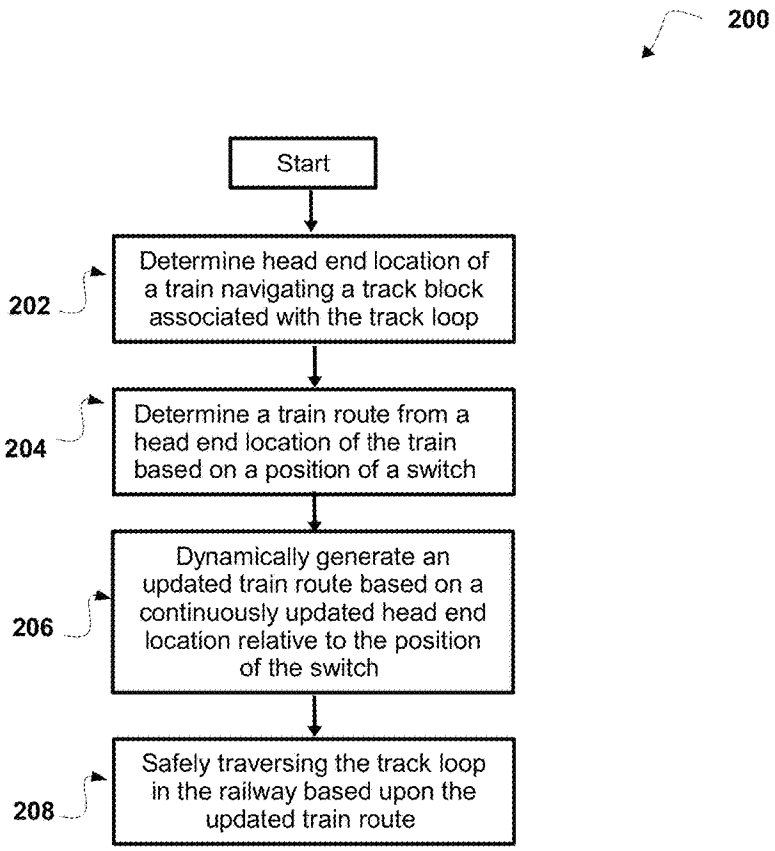
FIG. 2 illustrates a flowchart of a non-limiting embodiment of a process for safely navigating a track loop in a railway of a train according to a preferred and non-limiting embodiment or aspect.

Referring now to FIG. 2, FIG. 2 is a flowchart of a non-limiting embodiment or aspect of a process 200 for safely navigating a track loop in a railway. In some non-limiting embodiments or aspects, one or more of the steps of process 200 are performed (e.g., completely, partially, etc.) by on-board computer 102, remote server 104, and/or navigation system 106. In some non-limiting embodiments or aspects, one or more of the steps of process 200 are performed (e.g., completely, partially, etc.) by another device or a group of devices separate from or including on-board computer 102 (e.g., one or more processors of on-board computer 102, one or more processors of communication device 102*a*, one or more processors of visual display device 102*b*, one or more processors of train database 102*c*, etc.), remote server 104 (e.g., one or more processors of remote server 104, etc.), the navigation system 106 (e.g., one or more processors of navigation system 106, one or more processors of positioning system 106*a*, one or more speed sensors 106*b*, one or more inertial sensors 106*c*, etc.).

As shown in FIG. 2, at step 202, process 200 includes determining a head end location of a train navigating a track block associated with the track loop. For example, in some non-limiting embodiments or aspects, the on-board computer 102 determines a head end location of a train 10 navigating a track block in a plurality of track blocks associated with the track loop in the railway.

In some non-limiting embodiments or aspects, process 200 includes identifying the switch as a looping switch based on the switch in a location of a track block starting the track loop in the railway and a track block ending the track loop in the railway. For example, in some non-limiting embodiments or aspects, on-board computer 102 determines a location of a switch in a position starting a loop and also ending a loop. For example, a looping switch includes a switch position to provide an entrance to a track loop (e.g., a switch configured to allow a train 10 to enter a track block in a first track block of a track loop, and after train 10 traverses one or more blocks in a track block, a switch provides an exit from the track loop to provide an exit for the train 10 to leave the track loop.

In some non-limiting embodiments or aspects, process 200 includes receiving and/or obtaining train location information, track location information, switch location information, sensor information, navigation information, map data, authorization information, and/or the like.

As shown in FIG. 2, at step 204, process 200 includes determining a train route from a head end location of the train based on a position of a switch. For example, in some non-limiting embodiments or aspects, the on-board computer 102 determines a train route from the head end location of the train 10 including a forward path and a rearward path, the train route based on a position of a switch in the plurality of track blocks associated with the track loop in the railway. In some non-limiting embodiments or aspects, on-board computer 102 determines a route including route data based on a rearward path, a forward path, a path under the train 10, a path under the head of the train 10, and/or the like. In some non-limiting embodiments or aspects, on-board computer 102 determines a route including at least one of a rearward path, a forward path, a path under the train 10, a path under the head of the train 10, and/or the like that does not include or contain duplicate entries of track blocks or switches. For example, on-board computer 102 determines a route where rearward path data, forward path data, and path data for a path under the train 10 include unique track blocks relative to the route (e.g., the route does not include duplicate track blocks, etc.)

In some non-limiting embodiments or aspects, process 200 provides a train route including at least one of a forward path, a rearward path, an occupied path, and/or any combination of the like. For example, on-board computer 102 determines the forward path in at least one track block of the plurality of track blocks in an advance of the train 10 (e.g., from a location in the track network associated with a position of the head of the train 10). In another example, on-board computer 102 determines the rearward path in at least one track block of the plurality of track blocks behind the end of the train 10 (e.g. to the rear of the train 10, etc.). In another example, on-board computer 102 determines an occupied path in at least one track block, the occupied path under the train 10 including one or more track blocks of a route under the train 10 (e.g., forming a route, etc.). In some non-limiting embodiments or aspects, on-board computer 102 determines a train route, including at least one of the forward path, the rearward path, the occupied path, and/or any combination, wherein at least one of the forward path or the rearward path includes the occupied path under the train 10.

In some non-limiting embodiments or aspects, process 200 includes determining a portion of the rearward path starting at the head of the train 10, including one or more segments of track and one or more switches, if the one or more switches associated with the one or more track segments are longer than a length of the train 10 to cover. For example, on-board computer 102 determines a portion of the rearward path starting at the head of the train 10 to avoid entering a switch including a route having a track segment not longer than a length of the train 10 to cover (e.g., a length of a train 10 is less than a track loop, a length of the train 10 is shorter than the rearward route, etc.). In some non-limiting embodiments or aspects, on-board computer 102 determines a train 10 may not traverse a route including a portion of the rearward path starting at the head of the train 10 and at least one switch associated with at least one track segment shorter (e.g., not longer, etc.) than a length of the train 10 to cover. In some non-limiting embodiments or aspects, determining the rearward path comprises determining a segment of track immediately behind a track block associated with the head of the train 10 (e.g., a track block associated with a position behind a head of train location, etc.).

In some non-limiting embodiments or aspects, process 200 includes determining the forward path extending in advance of the head of the train 10 to include one or more segments of track and one or more switches. In some non-limiting embodiments or aspects, determining the forward path comprises determining the forward path includes a segment of track (e.g., a track block, etc.) associated with the head of the train 10.

In some non-limiting embodiments or aspects, process 200 includes determining the rearward path by combining the portion of the rearward path with a remaining rearward path extending behind the end of the train 10. For example, in some non-limiting embodiments or aspects, on-board computer 102 combines the portion of the rearward path with a remaining rearward path of one or more track blocks extending behind the rear of the train 10.

In some non-limiting embodiments or aspects, process 200 includes determining a train route by determining the position of the switch in a subset of track blocks of the plurality of track blocks in the forward path, wherein the subset of track blocks of the plurality of track blocks in the forward path are before the switch and the subset of track blocks of the plurality of track blocks in the rearward path are in a location after the switch.

As shown in FIG. 2, at step 206, process 200 includes dynamically generating an updated train route based on a continuously updated head end location relative to the position of the switch. For example, in some non-limiting embodiments or aspects, the on-board computer 102 dynamically generates an updated train route as the train 10 traverses the railway, based on a continuously updated head end location as the train 10 traverses the railway relative to the position of the switch. For example, on-board computer 102 generates an updated route at a predetermined interval (e.g., a threshold time, a period, an interval, etc.) as the train 10 traverses the railway. As an example, on-board computer 102 computes route data every second to pick up the changes in current location (if a train 10 is moving) and switch alignments. In another example, on-board computer 102 generates an updated route based on a position of a looping switch relative to train 10 as it traverses the track loop (e.g., as the looping switch moves from a forward route to a rearward route, etc.).

In some non-limiting embodiments or aspects, process 200 includes a forward path with the last track block preceding the looping switch if the looping switch is already included in the rearward path. In some non-limiting embodiments or aspects, In some non-limiting embodiments or aspects, process 200 includes determining a rearward path based on at least a remaining rearward path to include the last track block preceding the looping switch (e.g., a last track block in a rearward direction, etc.) if the looping switch is already included in the forward path generated.

As shown in FIG. 2, at step 208, process 200 includes safely traversing the track loop in the railway based upon the updated train route. For example, in some non-limiting embodiments or aspects, the on-board computer 102 safely traverses the track loop in the railway based upon the updated train route.

In some non-limiting embodiments or aspects, the on-board computer 102 safely traverses the track loop in the railway by operating the train 10 based on the updated train route. For example, on-board computer 102 navigates the route by safely traversing the loop track based on determining a predictive enforcement in advance of the train 10 associated with the forward path or a reactive enforcement associated with a track block under and/or behind the train 10. In some non-limiting embodiments or aspects, on-board computer 102 determines a condition in advance of the train 10 based on the route, one or more track blocks, and one or more switches in advance of the train 10 to determine a time to react and/or prevent a condition or enforcement in advance of the train 10. For example, on-board computer 102 may determine a predictive movement based on a track block in the forward route. For example, on-board computer 102 may determine if any speed targets in a forward track block of the forward path may be treated as predictive or reactive based on the route. For example, in some non-limiting embodiments or aspects, on-board computer 102 may determine a route where there is no condition in which either the reactive capabilities of the on-board computer 102 or the predictive capabilities of the on-board computer 102 may be used. In some non-limiting embodiments or aspects, on-board computer 102 may determine the route content (order of blocks) that are provided, published, viewed, displayed, communicated, and/or the like to all of the various systems and methods onboard the train 10 (i.e., processes) for other software methods and systems of the on-board system of the train 10 to ensure train safety and continuous navigation.

In some non-limiting embodiments or aspects, process 200 includes controlling the train 10 in the track loop based on determining a length of a subset of blocks in a track loop. In another example, on-board computer 102 determines to control the train to avoid a track loop based on determining a length of a subset of blocks in a track loop is less than the length of the train 10. In some non-limiting embodiments or aspects, automatically controlling the train 10 in the track loop based on determining a length of a subset of blocks in a track loop includes covering a track block detected in advance of the train 10. For example, on-board computer 102 determines how far ahead a track block is being projected in terms of distance. In some non-limiting embodiments or aspects, on-board computer 102 may determine a train's 10 length is larger than a track loop. In some non-limiting embodiments or aspects, on-board computer 102 may detect a condition and create a target for that condition to prevent the train 10 from entering the track loop because it would collide with itself as it traverses the loop.

In some non-limiting embodiments or aspects, on-board computer 102 dynamically generates a route, for example, updating when the relative approach to the looping switch changes.

In some non-limiting embodiments or aspects, on-board computer 102 communicates the route to one or more navigation systems 106, one or more remote servers 104, one or more on-board computers 102 (e.g., a computed route is published for other software modules of PTC on-board system, etc.), and/or the like.

In some non-limiting embodiments or aspects, process 200 includes safely traversing the track loop by operating the train 10 on the updated route based on reactive protection associated with one or more portions of the train 10.

In some non-limiting embodiments or aspects, process 200 includes predicting an upcoming condition in a forward path. In some non-limiting embodiments or aspects, process 200 includes controlling the train 10 based on the upcoming condition.

In some non-limiting embodiments or aspects, process 200 includes automatically issuing a train control command based on a condition in the rearward path under any portion of the train 10.

Referring now to FIGS. 3A-3E, FIGS. 3A-3E are diagrams of an overview of a non-limiting embodiment or aspect of an implementation 300 relating to one or more processes disclosed herein. As shown in FIGS. 3A-3E, implementation 300 includes train 10, locomotive 12, one or more railcars 14, and end of train railcar 16. Additionally, implementation 300 includes on-board computer 302. In some non-limiting embodiments or aspects, on-board computer 302 can be the same or similar to on-board computer 102. In some non-limiting embodiments or aspects, train 10 includes on-board computer systems that can be the same or similar to on-board computer systems as described in FIG. 1.

Figure 3A:
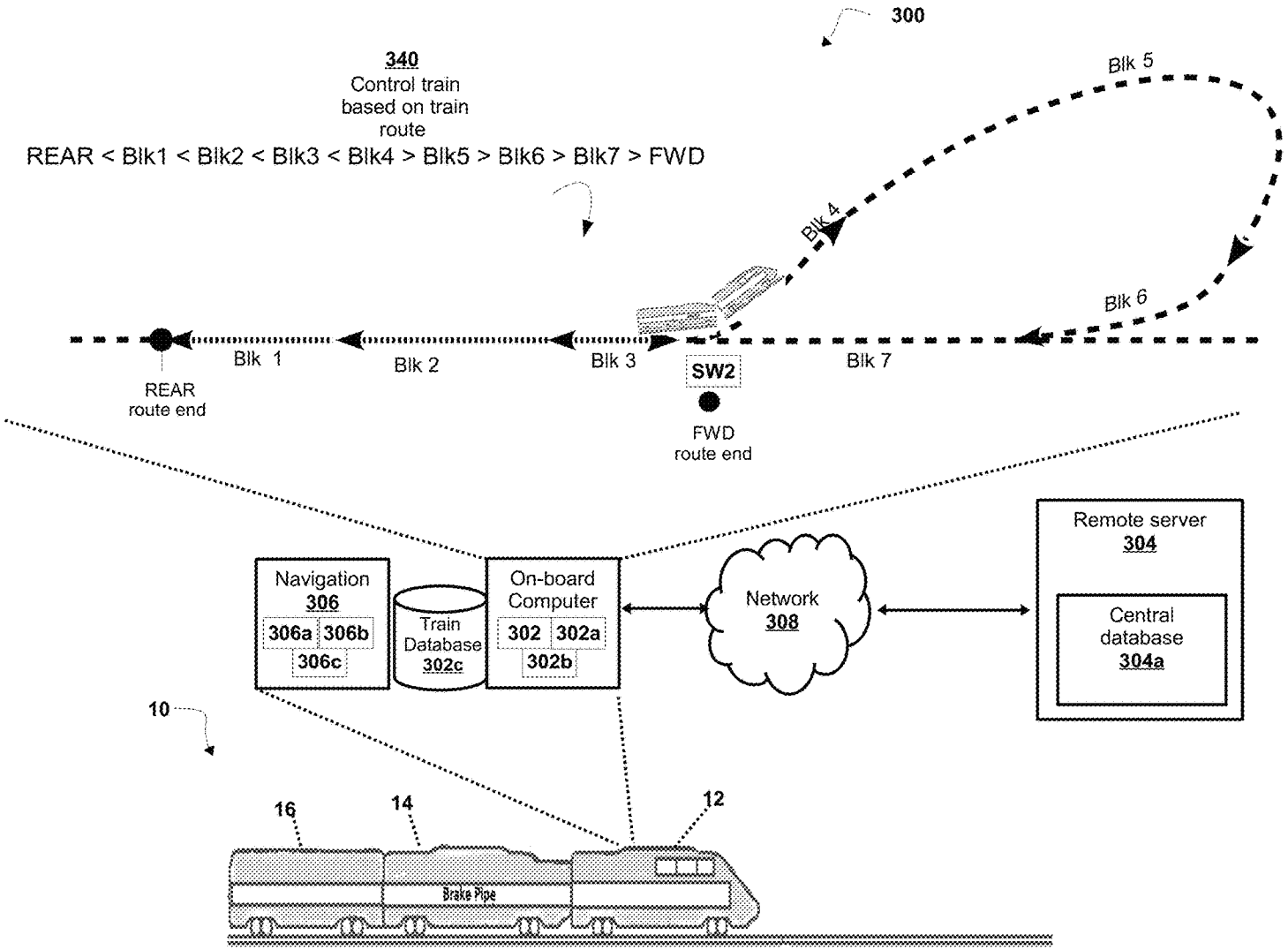
FIGS. 3A-3E illustrate an implementation of a non-limiting embodiment of a process disclosed herein according to a preferred and non-limiting embodiment or aspect.

As shown by reference number 340 in FIG. 3A, in some non-limiting embodiments or aspects, implementation 300 includes determining a route in one or more track blocks and one or more switches from the first track block at a position under the head of the train 10 (e.g., Blk4, etc.). As further shown, on-board computer 302 determines a path under the train 10 behind the first block (e.g., Blk3, etc.). As further shown, on-board computer 302 determines a forward path in advance of the first block (e.g., in a forward orientation, etc.), Blk4, including one or more track blocks or switches in advance of the first block, (e.g., SW3>Blk4>Blk5>Blk6>Blk7>FWD route end, etc.). As further shown, on-board computer 302 determines a rearward path behind the train 10, Blk3, including one or more track blocks or switches behind the first block in addition to the track blocks under the train 10, (e.g., REAR route end<Blk1<Blk2<Blk3<, etc.). The forward path ends at SW2, reaching SW2 a second time in the forward path.

Figure 3B:
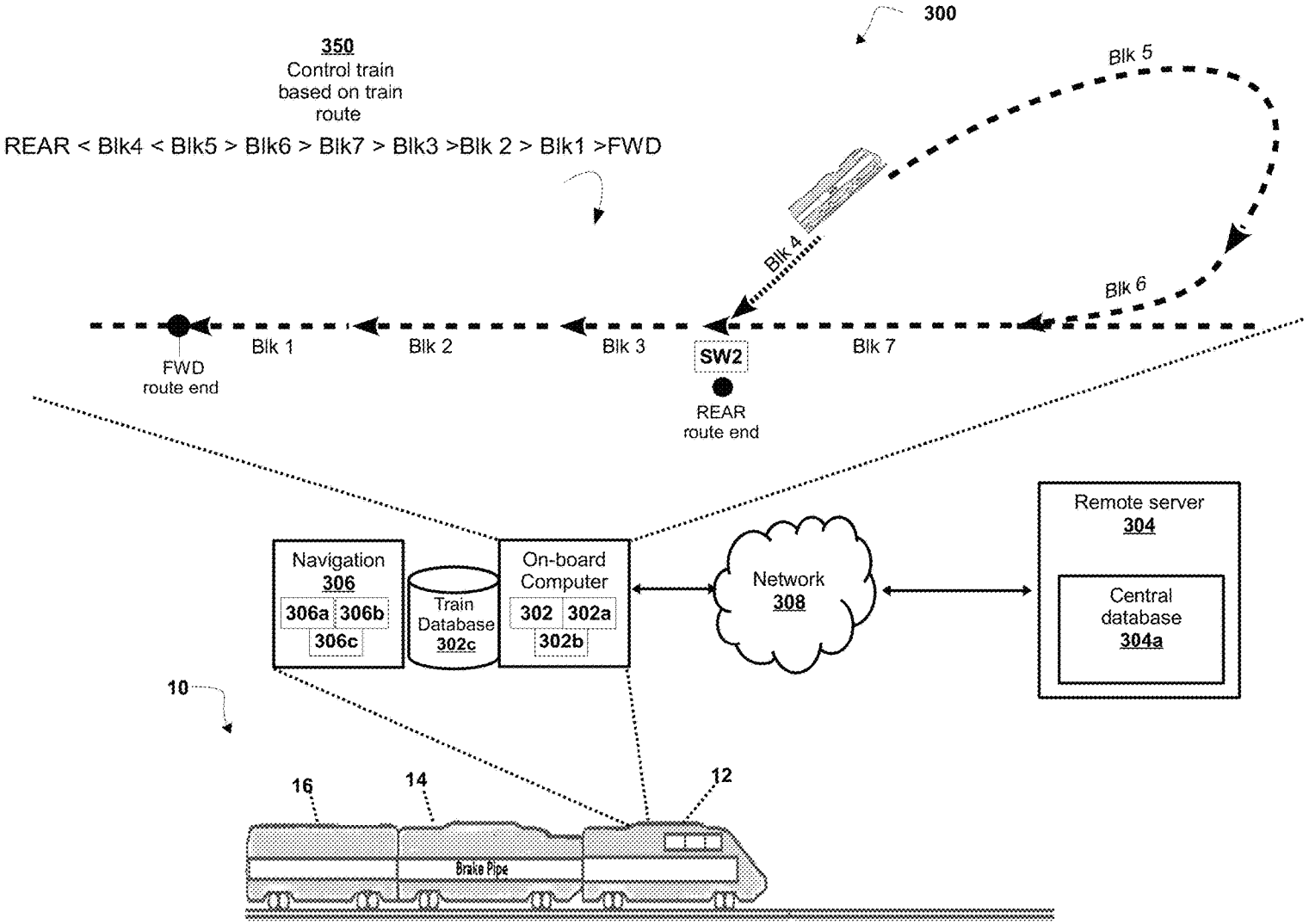

As shown by reference number 350 in FIG. 3B, in some non-limiting embodiments or aspects, implementation 300 includes determining a route in one or more track blocks and one or more switches from the first track block at a position under the head of the train 10 (e.g., Blk5, etc.). As further shown, on-board computer 302 determines a path under the train 10 behind the first block (e.g., Blk4, etc.). As further shown, on-board computer 302 determines a forward path in advance of the first block (e.g., in a forward orientation, etc.), Blk4, including one or more track blocks or switches in advance of the first block, (e.g., Blk5>Blk6>Blk7>SW2>Blk3>Blk2>Blk1>FWD route end, etc.). As further shown, on-board computer 302 determines a rearward path behind the train 10, Blk4, however no track blocks are behind the first blocks, and the rearward path includes only the track blocks under the train, (e.g., REAR route end<Blk4<, etc.).

Figure 3C:
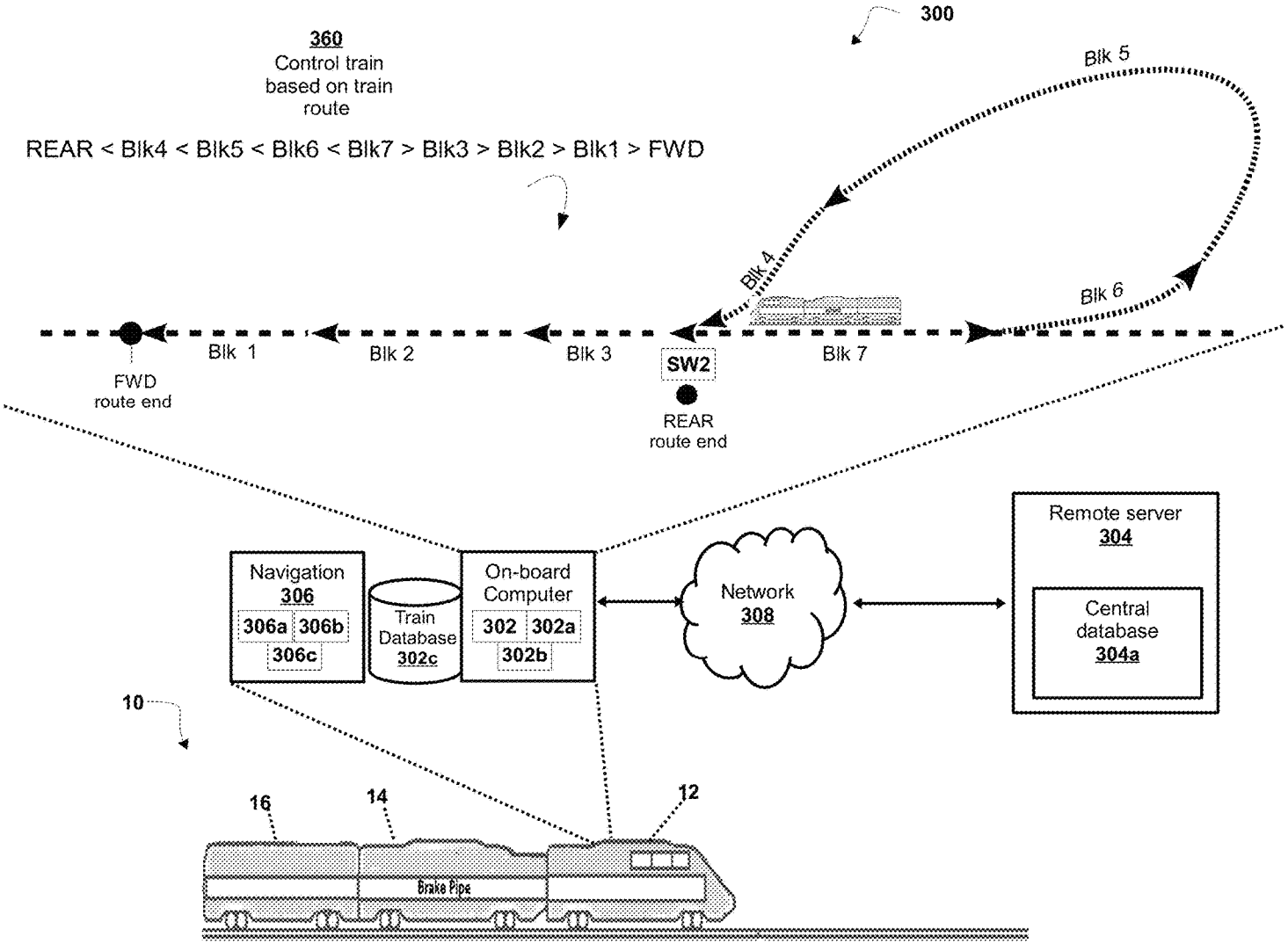

As shown by reference number 360 in FIG. 3C, in some non-limiting embodiments or aspects, implementation 300 includes determining a route in one or more track blocks and one or more switches from the first track block at a position under the head of the train 10 (e.g., Blk7, etc.). As further shown, on-board computer 302 determines no additional path under the train behind the first block (e.g., Blk7, etc.). As further shown, on-board computer 302 determines a forward path in advance of the first block (e.g., in a forward orientation, etc.), Blk4, including one or more track blocks or switches in advance of the first block, (e.g., Blk7>Blk3>Blk2>Blk1>FWD route end, etc.). As further shown, on-board computer 302 determines a rearward path behind the train 10, Blk4, however no track blocks are behind the first blocks, and the rearward path includes only the track blocks under the train 10, (e.g., REAR route end<Blk4<Blk5<Blk6<, etc.).

Figure 3D:
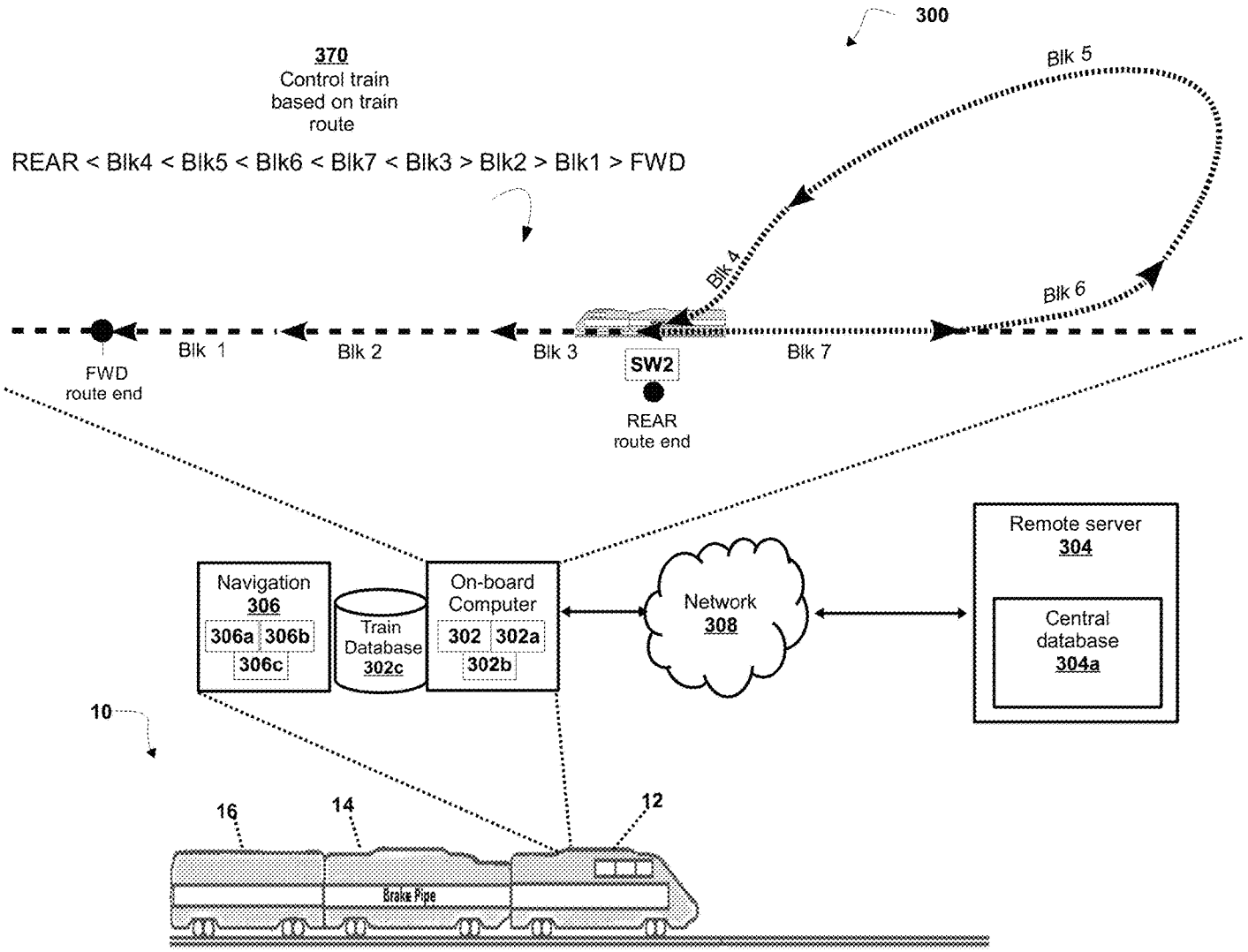

As shown by reference number 370 in FIG. 3D, in some non-limiting embodiments or aspects, implementation 300 includes determining a route in one or more track blocks and one or more switches from the first track block at a position under the head of the train 10 (e.g., Blk3, etc.). As further shown, on-board computer 302 determines an additional path under the train 10 behind the first block (e.g., Blk7, etc.). As further shown, on-board computer 302 determines a forward path in advance of the first block (e.g., in a forward orientation, etc.), Blk4, including one or more track blocks or switches in advance of the first block, (e.g., Blk3>Blk2>Blk1>FWD route end, etc.). As further shown, on-board computer 302 determines a rearward path behind the train 10, Blk4, however no track blocks are behind the first blocks, and the rearward path includes only the track blocks under the train 10, (e.g., REAR route end<Blk4<Blk5<Blk6<Blk7<, etc.).

Figure 3E:
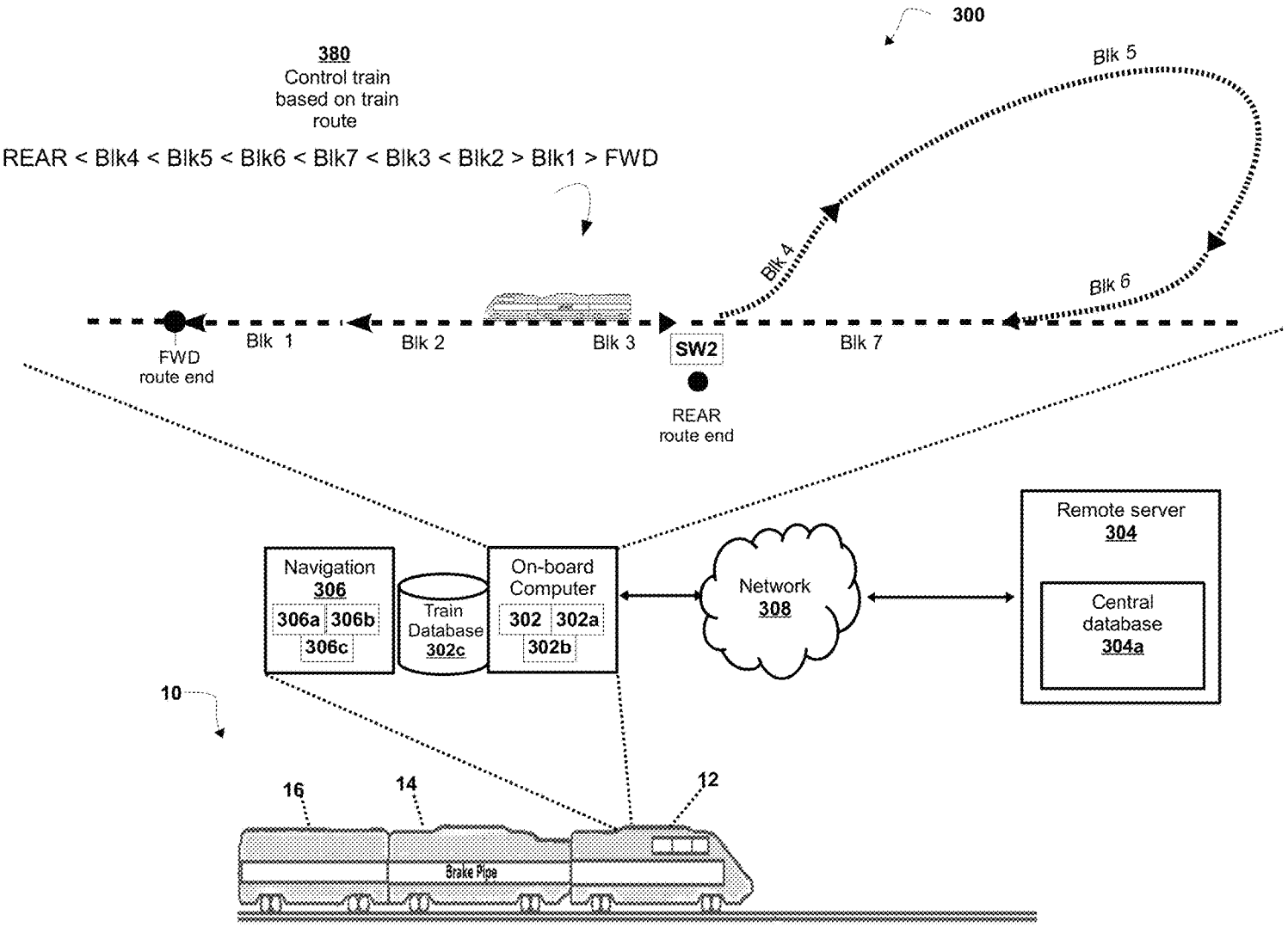

As shown by reference number 380 in FIG. 3E, in some non-limiting embodiments or aspects, implementation 300 includes determining a route in one or more track blocks and one or more switches from the first track block at a position under the head of the train 10 (e.g., Blk2, etc.). As further shown, on-board computer 302 determines an additional path under the train 10 behind the first block (e.g., Blk3, etc.). As further shown, on-board computer 302 determines a forward path in advance of the first block (e.g., in a forward orientation, etc.), Blk4, including one or more track blocks or switches in advance of the first block, (e.g., >Blk2>Blk1>FWD route end, etc.). As further shown, on-board computer 302 determines a rearward path behind the train 10, Blk4, however no track blocks are behind the first blocks, and the rearward path includes only the track blocks under the train 10, (e.g., REAR route end<Blk4<Blk5<Blk6<Blk7<Blk3, etc.).

Although embodiments or aspects have been described in detail for the purpose of illustration and description, it is to be understood that such detail is solely for that purpose and that embodiments or aspects are not limited to the disclosed embodiments or aspects, but, on the contrary, are intended to cover modifications and equivalent arrangements that are within the spirit and scope of the appended claims. For example, it is to be understood that the present disclosure contemplates that, to the extent possible, one or more features of any embodiment or aspect can be combined with one or more features of any other embodiment or aspect. In fact, many of these features can be combined in ways not specifically recited in the claims and/or disclosed in the specification. Although each dependent claim listed below may directly depend on only one claim, the disclosure of possible implementations includes each dependent claim in combination with every other claim in the claim set.

What is claimed is:

1. A train navigation method for safely navigating a track loop in a railway, the method comprising:

determining, by a computing system having one or more processors, a head end location of a train navigating a track block in a plurality of track blocks associated with the track loop in the railway;

determining, by the computing system, a train route from the head end location of the train, including a forward path and a rearward path, the train route based on a position of a switch in the plurality of track blocks associated with the track loop in the railway;

dynamically generating, by the computing system, an updated train route as the train traverses the railway, based on a continuously updated head end location as the train traverses the railway relative to the position of the switch; and safely traversing the track loop in the railway based upon the updated train route.

2. The train navigation method of claim 1, further comprising:

identifying, by the computing system, the switch as a looping switch based on the switch in a location of the track block starting the track loop in the railway and the track block ending the track loop in the railway; and determining the train route by determining the position of the switch in a subset of track blocks of the plurality of track blocks in the forward path, wherein the subset of track blocks of the plurality of track blocks in the forward path are before the switch and the subset of track blocks of the plurality of track blocks in the rearward path are in a location after the switch.

3. The method of claim 2, wherein the train route includes at least one of the forward path in at least one track block of the plurality of track blocks in an advance of the train, a path in at least one track block of the plurality of track blocks behind the end of the train, an occupied path in at least one track block of the plurality of track blocks under the train, or any combination, wherein at least one of the forward path or the rearward path includes the occupied path under the train.

4. The method of claim 3, wherein determining route data comprises:

determining a portion of the rearward path starting at a head of the train, including one or more segments of track and one or more switches, the one or more switches associated with track segments longer than a length of the train to cover;

determining the forward path extending in advance of the head of the train, including one or more segments of track and one or more switches; and determining the rearward path by combining the portion of the rearward path with a remaining rearward path extending behind the end of the train.

5. The method of claim 4, wherein the forward path includes the last track block preceding a looping switch if the looping switch is already included in the rearward path, and wherein the remaining rearward path includes the last track block preceding the looping switch if the looping switch is already included in the forward path generated.

6. The method of claim 5, wherein determining the forward path, further comprises determining the forward path includes the segment of track associated with the head of the train.

7. The method of claim 5, wherein safely traversing the track loop based upon the updated route is accomplished by operating the train on the updated route including predictive enforcement in advance of the train, further comprising:

controlling the train in the track loop based on determining the length of the subset of blocks in the track loop is greater than the length of the train.

8. The method of claim 7, wherein safely traversing the track loop includes operating the train on the updated route based on reactive protection associated with one or more portions of the train, comprising:

predicting an upcoming condition in the forward path; and controlling the train based on the upcoming condition.

9. The method of claim 8, comprising:

automatically issuing a train control command based on a condition in the rearward path under any portion of the train.

10. An on-board navigation system for generating a train route in a railway, comprising:

a computing system including one or more processors configured to:

determine a head end location of a train navigating a track block in a plurality of track blocks associated with a track loop in the railway;

determine the train route from the head end location of the train including a forward path and a rearward path, the train route based on a position of a switch in the plurality of track blocks associated with the track loop in the railway;

dynamically generate an updated train route as the train traverses the railway, based on a continuously updated head end location as the train traverses the railway relative to the position of the switch; and safely traverse the track loop in the railway based upon the updated train route.

11. The on-board navigation system of claim 10, wherein the computing system is further configured to:

identify the switch as a looping switch based on the switch in a location of the track block starting the track loop in the railway and the track block ending the track loop in the railway; and determine the train route by determining the position of the switch in a subset of track blocks of the plurality of track blocks in the forward path, wherein the subset of track blocks of the plurality of track blocks in the forward path are before the switch and the subset of track blocks of the plurality of track blocks in the rearward path are in a location after the switch.

12. The on-board navigation system of claim 11, wherein the train route includes at least one of the forward path in at least one track block of the plurality of track blocks in an advance of the train, a path in at least one track block of the plurality of track blocks behind the end of the train, an occupied path in at least one track block of the plurality of track blocks under the train, or any combination, wherein at least one of the forward path or the rearward path includes the occupied path under the train.

13. The on-board navigation system of claim 12, wherein the computing system is further configured to determine the route data by:

determining a portion of the rearward path starting at a head of the train, including one or more segments of track and one or more switches, the one or more switches associated with track segments longer than a length of the train to cover;

determining the forward path extending in advance of the head of the train, including one or more segments of track and one or more switches; and determining the rearward path by combining the portion of the rearward path with a remaining rearward path extending behind the end of the train.

14. The on-board navigation system of claim 13, wherein the forward path includes a last track block preceding the looping switch if the looping switch is already included in the rearward path and the remaining rearward path includes the last track block preceding the looping switch if the looping switch is already included in the forward path generated.

15. The on-board navigation system of claim 14, wherein the forward path includes the segment of track associated with the head of the train.

16. The on-board navigation system of claim 15, wherein the computing system is further configured to safely traverse the track loop based upon the updated route by:

operating the train on the updated route including predictive enforcement in advance of the train; and predicting the upcoming condition in the forward path; and controlling the train based on the upcoming condition.

17. The on-board navigation system of claim 16, wherein the computing system is further configured to:

operate the train on the updated route based on reactive protection associated with one or more portions of the train; and control the train in the track loop based on determining the length of the subset of blocks in the track loop is greater than the length of the train.

18. An on-board dynamic train control method for safely traversing a track loop in a railway, the method comprising:

determining, by a computing system having one or more processors, route data including a first track block in a forward path of a looping switch in a track loop;

generating, by the computing system, an updated route based on the route data, the updated route including the first track block in a rearward path of the updated route data based on an updated position of the train relative to the looping switch;

determining, by an on-board computer having one or more processors, total route distance of the track loop; and safely traversing the track loop based upon the updated route.

19. The method of claim 18, wherein safely traversing the track loop further comprises:

operating the train on the updated route based on reactive protection associated with one or more portions of the train;

predicting an upcoming condition in the forward path based on the distance of the track loop; and controlling the train based on the upcoming condition.

20. The method of claim 18, wherein safely traversing the track loop further comprises:

operating the train on the updated route including predictive enforcement in advance of the train, further comprising:

determining the looping switch in the railway associated with a segment of track for entering the track loop in the railway; and safely traversing the track loop based upon the updated train route by controlling the train in the track loop based on determining a length of a subset of blocks in the track loop is greater than the length of the train.

* * * * *